US006234847B1

(12) United States Patent
Chang

(10) Patent No.: US 6,234,847 B1
(45) Date of Patent: May 22, 2001

(54) ELECTRICAL CONNECTOR HAVING AN INSERT MODULE AND A CIRCUIT BOARD IN CONTACT WITH THE INSERT MODULE

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/304,123

(22) Filed: May 3, 1999

(30) Foreign Application Priority Data

Nov. 27, 1998 (TW) ..... 87219756
Dec. 1, 1998 (TW) ..... 87220011

(51) Int. Cl.[7] ..... H01R 24/00
(52) U.S. Cl. ..... 439/676
(58) Field of Search ..... 439/676, 660, 439/626, 627

(56) References Cited

U.S. PATENT DOCUMENTS 5,178,549 * 1/1993 Neumann et al. ..... 439/74
5,463,191 * 10/1995 Bell et al. ..... 174/263
5,647,767 * 7/1997 Scheer et al. ..... 439/620
5,989,069 * 11/1999 Tan ..... 439/620

* cited by examiner

*Primary Examiner*—Khiem Nguyen
*Assistant Examiner*—Michael C. Zarroli
(74) *Attorney, Agent, or Firm*—Wei Te Chung

(57) ABSTRACT

An electrical connector comprises a housing defining a front mating opening and a rear surface, a modular subassembly fixed to the insulative housing and a shell defining a pair of resilient arms. The modular subassembly includes an insert module and a circuit board being located adjacent to the rear surface of the insulative housing. The circuit board forms a conductive coating thereon for groundingly contacting with the resilient arms of the shell, and the insert module consists of an upper insert member receiving a number of first contacts and a lower insert member receiving a number of second contacts.

21 Claims, 7 Drawing Sheets

ELECTRICAL CONNECTOR HAVING AN INSERT MODULE AND A CIRCUIT BOARD IN CONTACT WITH THE INSERT MODULE

BACKGROUND OF THE INVENTION

The invention relates to an electrical connector, and especially to a modular jack electrical connector assembly which provides stable and reliable electrical communication.

As the communication industry rapidly develops, a wide variety of electrical products relating to communication networks have been introduced to the market. Current electrical instruments must process an increasing amount of information and especially, the transmission of the high frequency signals become common between electrical instruments. Thus, filter requirements are being placed on the quality of electrical products to ensure proper signal transmission. Emphasized is how to lessen the negative affects of noise signals acting on communication devices. U.S. Pat. Nos. 5,069,641; 5,587,884; and 5,647,767 disclose electrical connectors for communication devices which address the problem of noise.

The conventional connectors are usually equipped with signal transforming devices for reducing the affects of noise signals. However, a number of conductive terminals received within the electrical connector must be divided into groups for connecting with the signal transforming device to ensure proper transmission of signals. Furthermore, the conventional signal transforming device assembled within electrical connector usually lacks an electrical element to eliminate noise signals.

Alternative electrical connectors often adopt a grounding device having at least a grounding lead for grounding noise signals. However, the grounding leads must be soldered to the grounding device and to a circuit board, which results in complicating the manufacture and assembly process, as well as increasing costs. Additionally, a number of auxiliary structures or components must be provided for cooperating with the grounding leads thereby further hindering manufacture and assembly.

BRIEF SUMMARY OF THE INVENTION

The main object of the present invention is to provide an electrical connector having a modular subassembly containing a plurality of conductive components of the connector to facilitate assembly with other components of the connector and promoting stable and reliable signal transmission between the connector and a mating connector.

The second object of the present invention is to provide an electrical connector having a modular subassembly having a circuit board attached to a rear surface of the insulative housing thereby providing enough space for containing predetermined electrical elements for filtering and conditioning noise signals.

The third object of the present invention is to provide an electrical connector including a modular subassembly having a coat of conductive material applied thereto in cooperation with a shell conveniently and steadily fixed to an insulative housing of the connector thereby providing the connector with shielding and grounding capabilities.

In accordance with one aspect of the present invention, the modular subassembly attached to the connector includes an insert module and a circuit board with a number of electrical elements attached thereto. The module consists of an upper insert member receiving a plurality of first contacts therein, a lower insert member receiving a plurality of second contacts therein. Thus, the modular subassembly can be conveniently assembled with the other components of the connector as a whole thereby simplifying the structure of the connector and providing enough space for containing sufficient electrical elements attached to the subassembly.

Moreover, a coat of conductive material, such as a coat of tin foil, is provided on an edge of the circuit board of the modular subassembly for completing a grounding path from electrically contacting resilient arms of a shell enclosing the insulative housing to the modular subassembly.

In accordance with another aspect of the present invention, the shell forms two inwardly extending resilient arms for electrically contacting with the conductive coating of the modular subassembly, grounding tabs and a rear cover, thereby providing the electrical connector with both the grounding and shielding capabilities.

DETAILED DESCRIPTION OF THE PREFERRED EMBODIMENT

Figure 1:
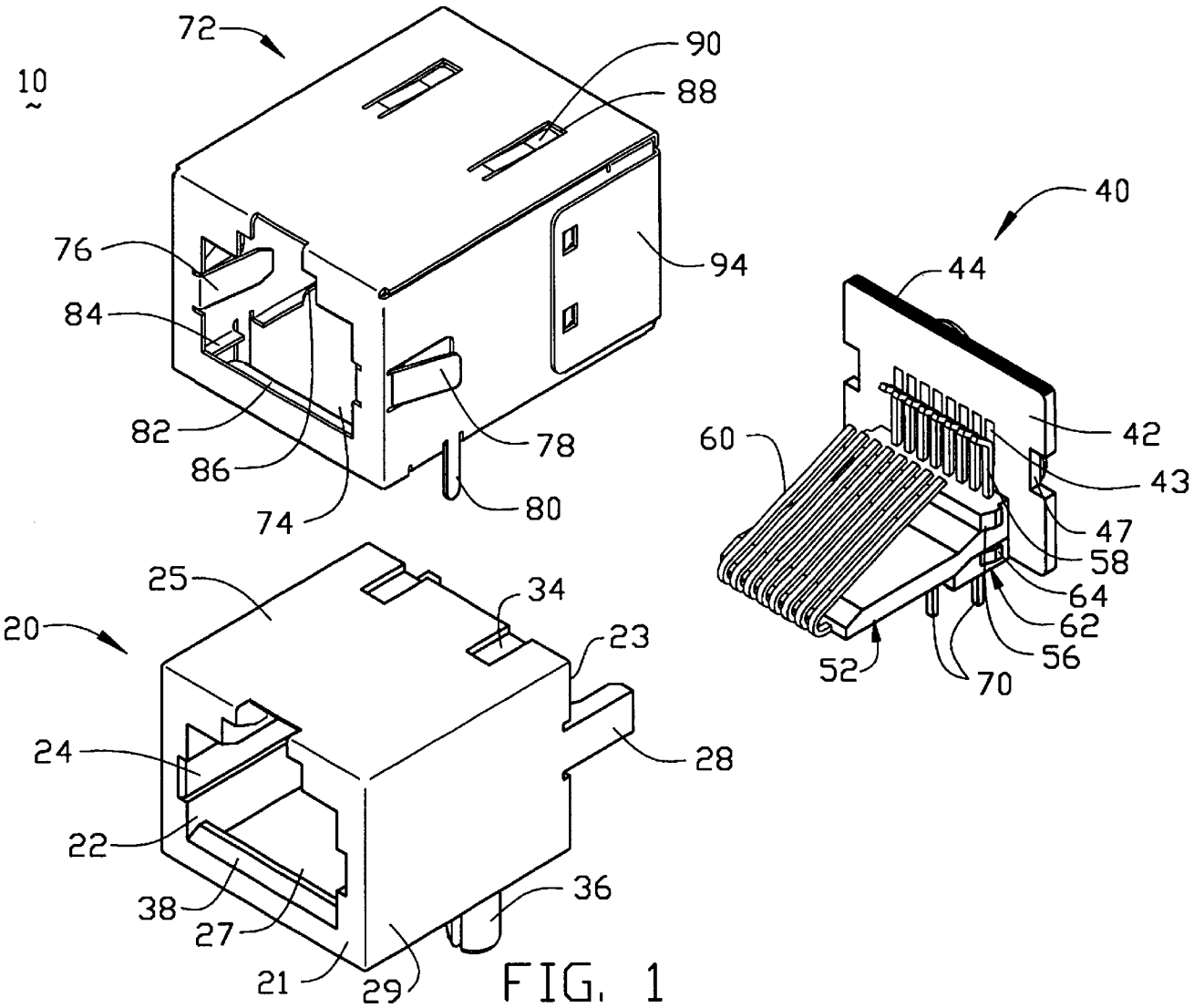
FIG. 1 is a partially exploded view of an electrical connector assembly in accordance with the present invention.
Figure 7:
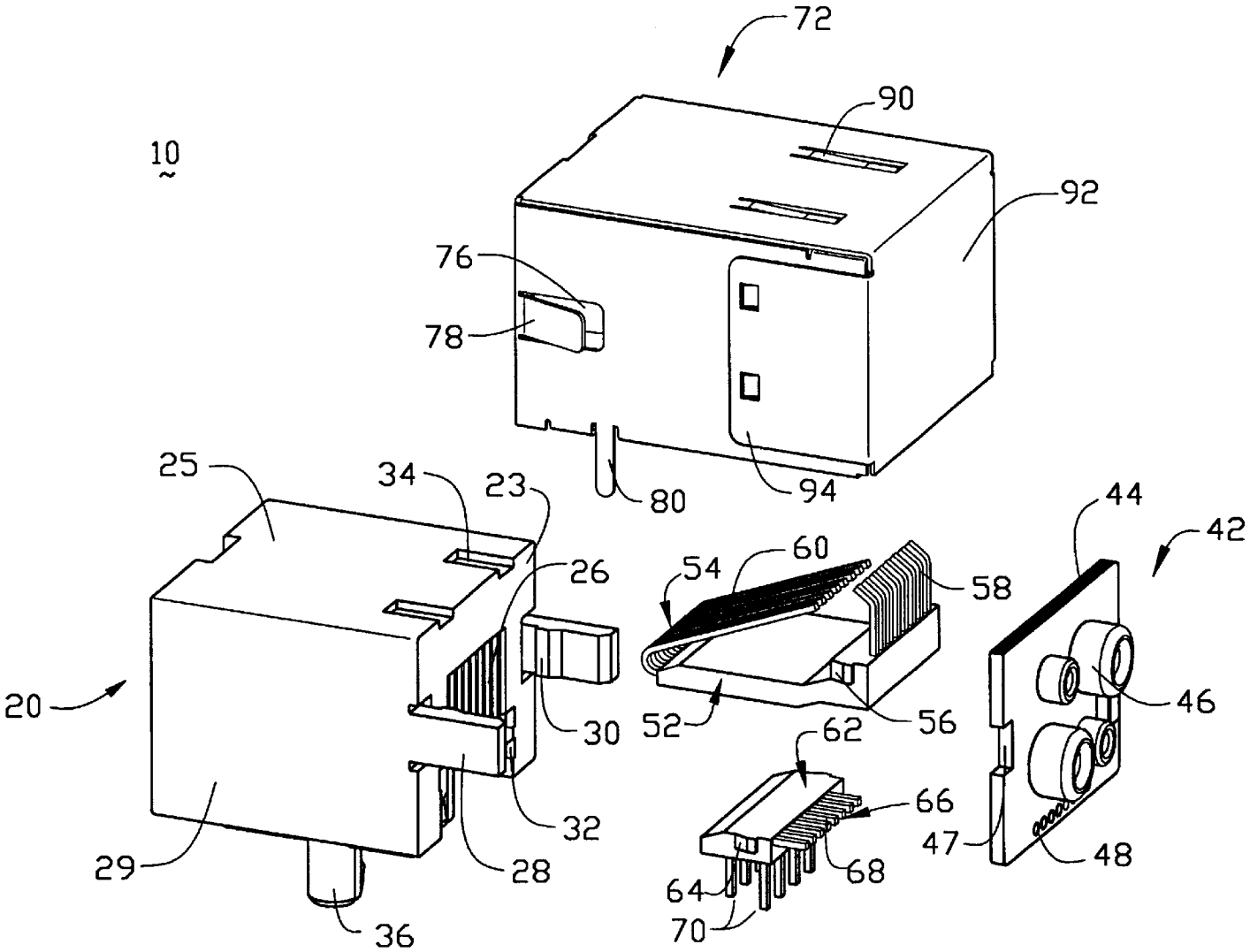
FIG. 7 is a fully exploded view of the present invention.

Referring to FIGS. 1 and 7, an electrical connector 10 comprises an insulative housing 20, a modular subassembly 40 and a shell 72. The insulative housing 20 has a front face 21, a rear face 23, a top face 25, and a pair of side faces 29. A front mating opening 22 is defined in the front face 21 and a number of contact receiving passageways 26 are defined in the rear face 23. A chamber 27 defined between the front and rear face 21, 23. A pair of groove 24 are defined on opposite inner sides of the insulative housing 20 between the front and rear faces 21, 23. A strip 38 is formed along a periphery of the mating opening 22. Two supporting posts 36 downwardly extend from the insulative housing 20. A pair of cantilevered arms 28 extend from the rear face 23 of the insulative housing 20. Each arm 28 forms a protrusion 30 on an inner surface thereof. A space is defined between the two arms 28 for receiving a circuit board 42 of the modular subassembly 40. A pair of recesses 34 are disposed in the top face 25 of the insulative housing 20. A pair of securing slots 32 are oppositely deposited in the rear face 23 of the insulative housing 20, each securing slot 32 having an upper slot and a lower slot for alternately interferentially receiving first and second projections of upper and lower insert members 52, 62 as detailed later.

Figure 2:
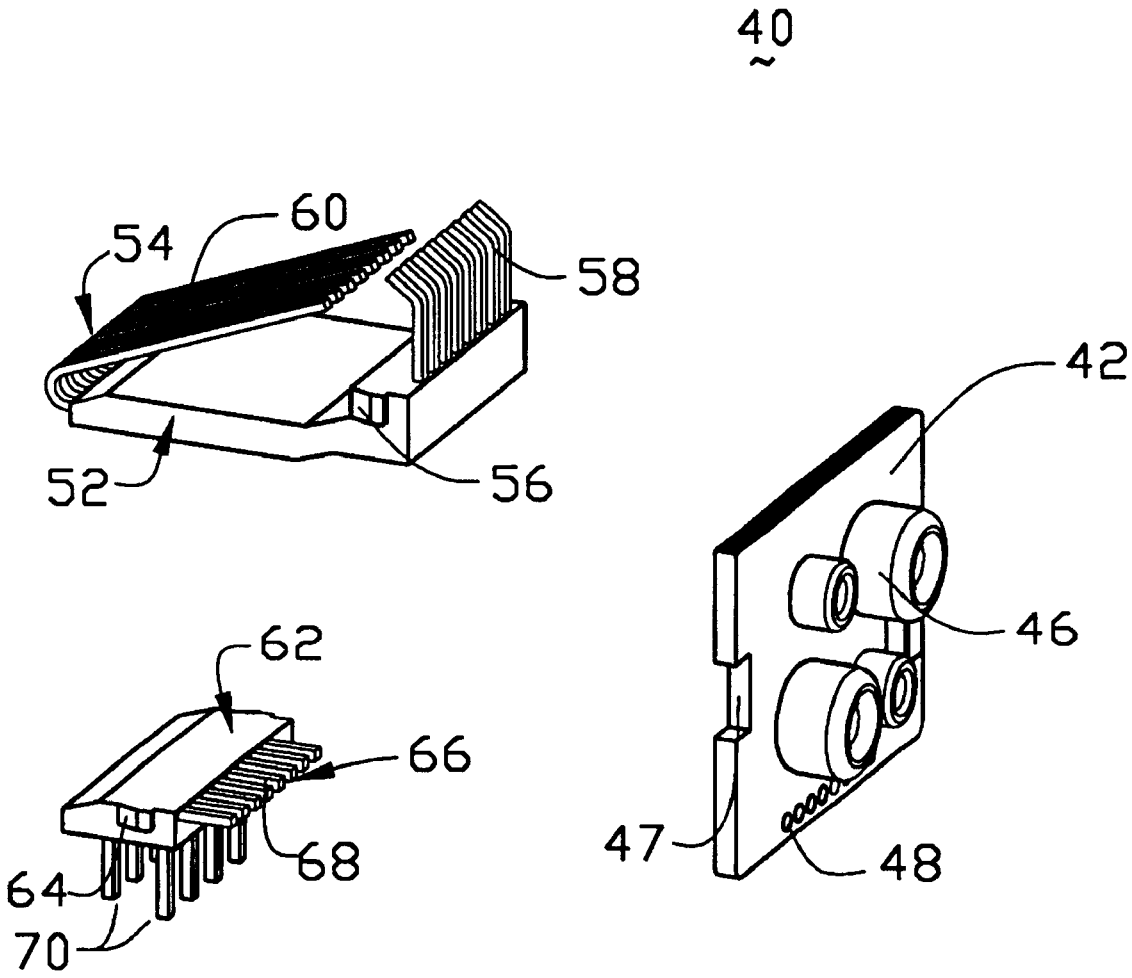
FIG. 2 is an exploded view of a modular subassembly in accordance with the present invention.
Figure 3:
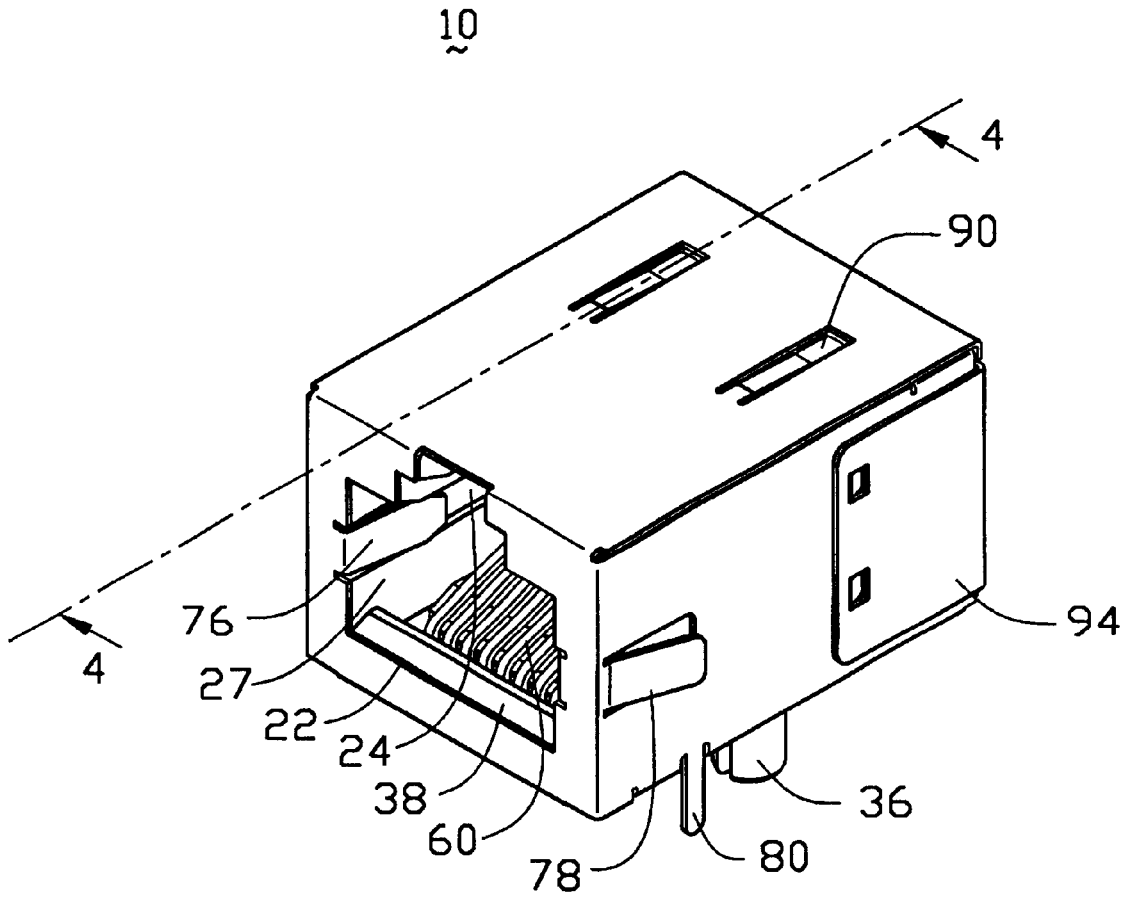
FIG. 3 is an assembled view of FIG. 1.
Figure 4:
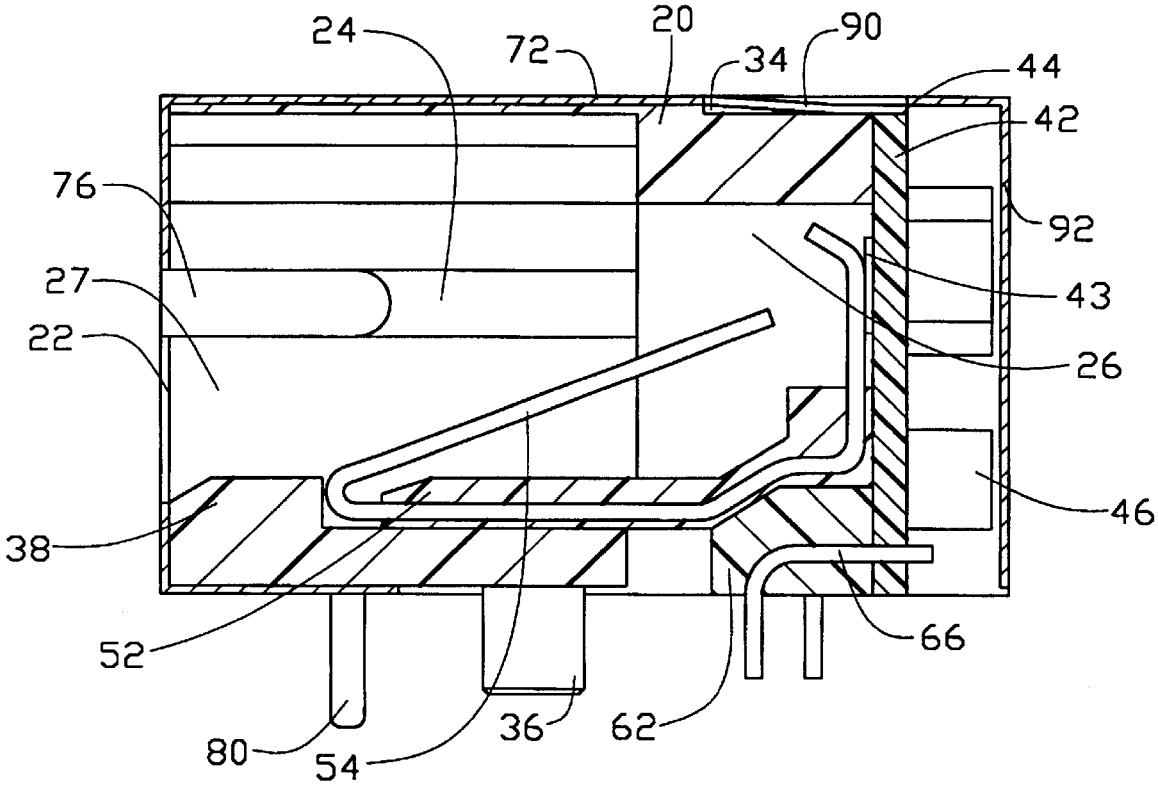
FIG. 4 is a cross sectional view taken along line 4—4 of FIG. 3.
Figure 5:
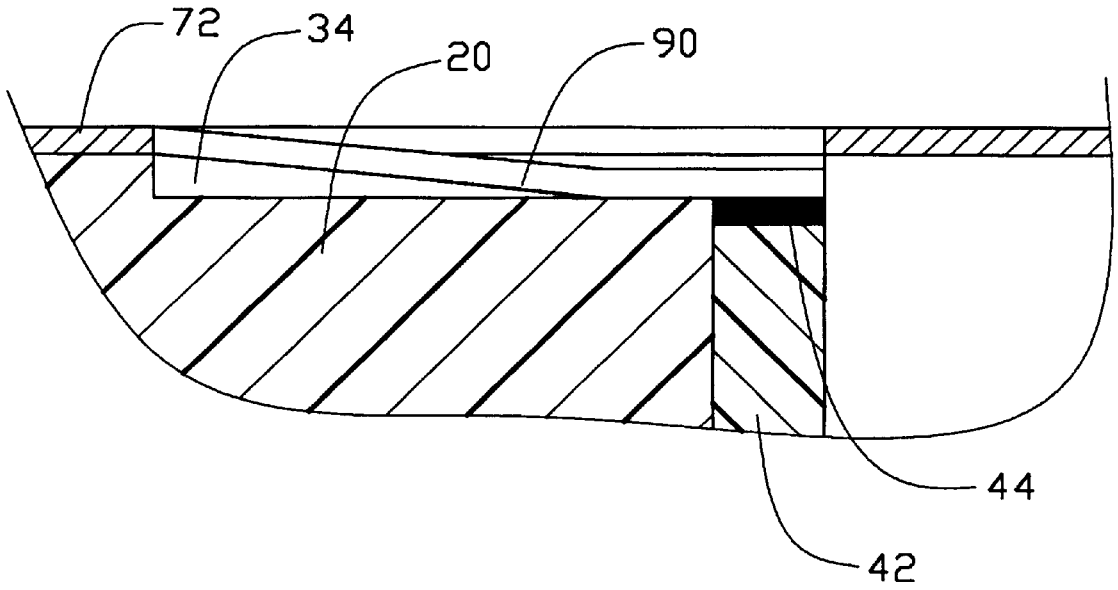
FIG. 5 is a partially magnified view of FIG. 4.

Also referring to FIG. 2, the modular subassembly 40 includes an insert modular (not labeled) and a circuit board 42, the insert modular consists of an upper insert member 52 and a lower insert member 62. The upper insert member 52 receives a plurality of first contacts 54 therein and the lower insert member 62 receives a plurality of second contacts 66 therein. In the embodiment shown, the upper insert member 52 and the lower insert member 62 are shown to be separate elements, however, they can be integrally formed if desired.

Each first contact 54 comprises a mounting section 58 vertically extending from one end of the upper insert member 52, a contact section 60 acutely extending from an opposite end of the upper insert member 52, and a securing section (not shown) received in the upper insert member 52. The contact sections 60 can electrically contact with corresponding terminals of a mating connector (not shown). Each second contact 66 comprises a soldering section 68 rearwardly extending from the lower insert member 62, and a connecting section 70 downwardly extending therefrom. The upper insert member 52 is an insulative plate forming a pair of first projection 56 extending from opposite sides thereof. The lower insert member 62 forms a pair of second projections 64 on opposite lateral ends thereof.

The circuit board 42 has a number of electrical elements 46 arranged thereon. A number of conductive pads 43 are attached to a surface of the circuit board 42 for surface mounting the corresponding mounting sections 58 of the first contacts 54 thereto. A number of electronic elements 46 are attached on a surface opposite to the surface mounted the conductive pads 43 thereon for filtering and conditioning noise signals. A number of holes 48 are defined through the circuit board 42 for receiving the soldering sections 68 of the second contacts 66 therein. A coat of conductive material 44, such as a coat of tin foil, is deposited along a top edge of the circuit board 42. A pair of cutouts 47 are defined on opposite lateral side of the circuit board 42.

Figure 6:
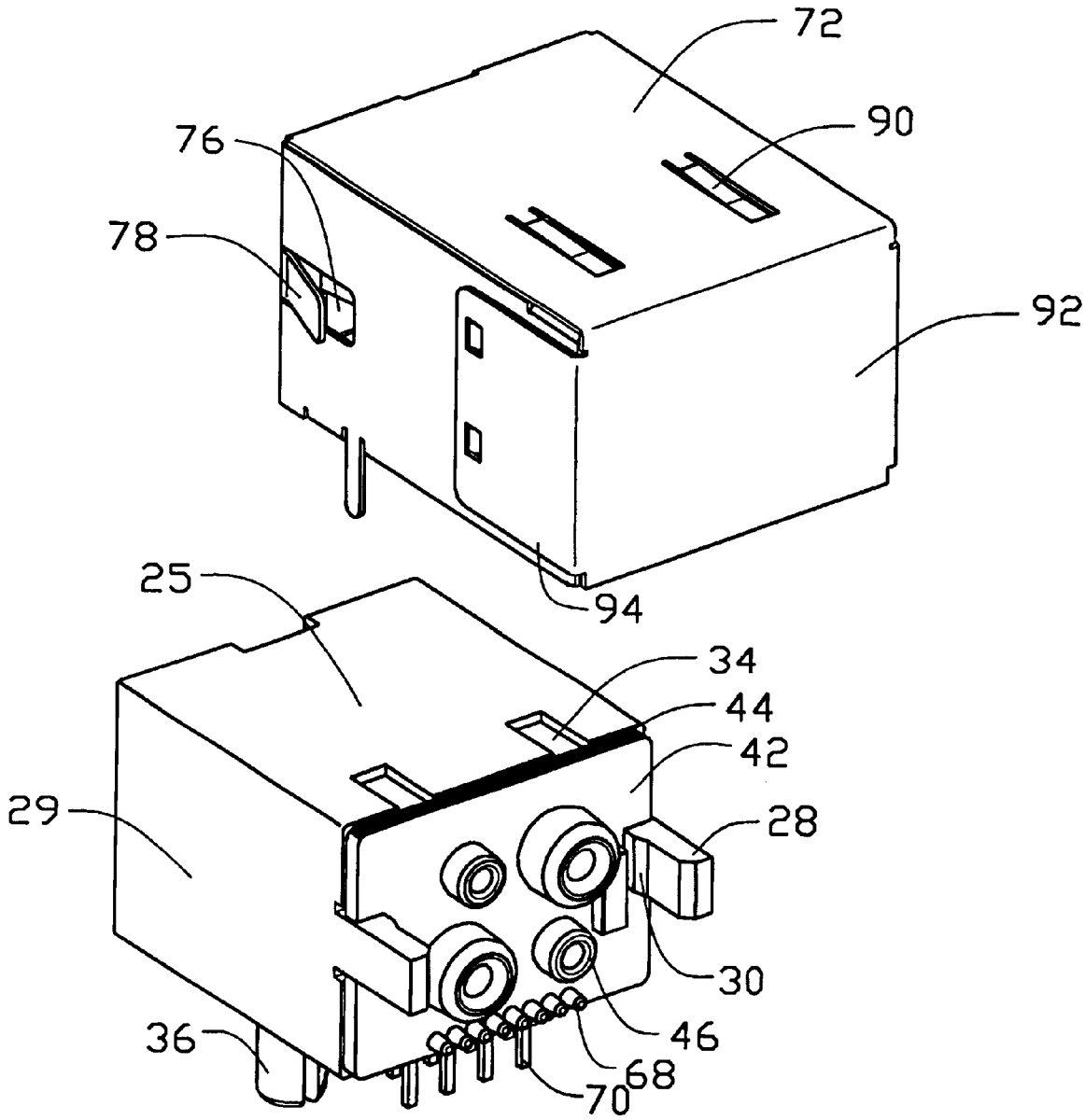
FIG. 6 is a partially assembled view of FIG. 1.

Referring to FIGS. 1, 6 and 7, the shell 72 defines a cavity 74 in a front face thereof corresponding to the mating opening 22 of the insulative housing 20. A pair of inner and outer grounding tabs 76, 78 are formed on each of opposite sides of the shell 72 proximate the cavity 74. A rear cover 92 is formed opposite to the cavity 74 and two bent tabs (not labeled) extend from opposite sides of the rear cover 92 to abut against the corresponding opposite sides of the housing 20. A pair of inwardly extending resilient arms 90 are formed on a top face of the shell 72. A pair of legs 80 downwardly extend from the shell 72. A first flange 82 inwardly extend from a bottom edge of the front face of the shell 72. A pair of second flange 84 inwardly extends from a bottom edge of the opposite sides of the shell 72. Each second flange 84 defines an arcuate notch 86 for extension of the corresponding supporting posts 36 of the insulative housing 20 therethrough.

Referring to FIG. 1 and FIG. 2, in assembly, the mounting sections 58 of the first contacts 54 are surface mounted to the corresponding conductive pads 43 of the circuit board 42, and the soldering sections 68 are soldered to the corresponding holes 48 thereof. A surface of the lower insert member 62 abuts against a bottom surface of the upper insert member 52.

Referring to FIGS. 1, 4, 6 and 7, the modular subassembly 40 is assembled to the insulative housing 20 by inserting the upper insert member 52 into the chamber 27. The contact sections 60 of the first contacts 54 are received in the corresponding contact receiving passageways 26 and extend into the chamber 27 whereby bent portions of the contact sections 60 abuts against the strip 38. The circuit board 42 is received between the two cantilevered arms 28 to abut against the insulative housing 20 and whereby the protrusions 30 of the housing 20 engage with the corresponding cutouts 47 to secure the circuit board 42 to the insulative housing 20.

Referring to FIGS. 1, 3, 4 and 5, the shell 72 is fixed to the combination of the insulative housing 20 and the modular subassembly 40. The first flange 82 of the housing 20 is positioned below the strip 38 of the insulative housing 20, and the second flanges 84 are positioned below the opposite sides of the insulative housing 20 and thus, the insulative housing 20 is retained in the shell 72. The rear cover 92 encloses the circuit board 42. The resilient arms 90 extend into the corresponding recess 34 and abut against the coat of conductive material 44 for facilitating electrical connection between the shell 72 and the circuit board 42 for grounding protection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a front mating opening for receiving a mating connector and a rear surface; and a modular subassembly comprising an insert module fixedly mounted to the insulative housing and a circuit board in electrical contact with the insert module and abutting against the rear surface of the insulative housing the circuit board comprising a plurality of electrical elements attached to one main surface thereof and a plurality of conductive pads attached to the other main surface thereof, the circuit board defining a plurality of holes between the two main surfaces and a pair of cutouts in two opposite side surfaces thereof.

2. The electrical connector as claimed in claim 1, wherein the housing defines a pair of cantilevers extending from two opposite sides of the rear surface for securely engaging the cutouts of the circuit board.

3. The electrical connector as claimed in claim 1, wherein the insert module comprises an upper insert member receiving a plurality of first contacts and a lower insert member receiving a plurality of second contacts.

4. The electrical connector as claimed in claim 3, wherein each first contact comprises a mounting section, a securing section and a contact section, the mounting section extending from an end of the upper insert member for being soldered to corresponding conductive pads, the securing section being received in the upper insert member, and the contact section acutely extending into the insulative housing for electrically contacting corresponding terminals of a mating connector.

5. The electrical connector as claimed in claim 3, wherein each second contacts comprises a soldering section, a securing section and a connecting section, the soldering section rearwardly extending from the lower insert member for being soldered to corresponding holes of the circuit board of the modular subassembly, the securing section being received in the lower insert member, and the connecting section downwardly extending from the lower insert member for electrically connecting with a mating mother board.

6. The electrical connector as claimed in claim 3, wherein a pair of first projections is deposited on two side walls of the upper insert member of the insert module for engaging to the insulative housing, and a pair of second projections is deposited on two side walls of the lower insert member of the insert module for engaging to the insulative housing.

7. The electrical connector as claimed in claim 1, wherein the insulative housing defines a plurality of contact receiving passageways in the rear surface thereof, a chamber between the mating opening and the rear surface, and a pair of securing slots oppositely defined in the rear face, each securing slot having an upper slot and a lower slot for interferentially receiving the first and second projections of the upper and lower insert members, respectively.

8. The electrical connector as claimed in claim 1, wherein the insulative housing defines a pair of grooves in opposite inner sides thereof between the mating opening and the rear surface.

9. The electrical connector as claimed in claim 8, wherein a shell is provided for grounding and shielding the electrical connector, the shell having a cavity corresponding to the mating opening of the insulative housing, a pair of inner grounding tabs and a pair of outer grounding tabs being formed on opposite sides of the shell, the pair of inner grounding tabs being received in the grooves of the insulative housing, and a downwardly extending rear cover having two bent tabs abutting against the opposite sides of the insulative housing.

10. An electrical connector for electrically connecting a mating connector, comprising:

an insulative housing defining a front mating opening for receiving a mating connector and a rear surface;

a modular subassembly comprising an insert module fixed to the insulative housing and a circuit board located outside the insulative housing, the circuit board having a conductive coating thereon, a plurality of electrical elements attached on one main surface of the circuit board, a plurality of conductive pads attached on an opposite main surface of the circuit board and a plurality of holes defined between the two main surfaces; and a shell enclosing the insulative housing, the shell being in electrical contact with the conductive coating of the circuit board.

11. The electrical connector as claimed in claim 10, wherein the conductive coating is disposed on an edge of the circuit board.

12. The electrical connector as claimed in claim 10, wherein the conductive coating is a coat of tin foil.

13. The electrical connector as claimed in claim 10, wherein the insert module of the modular subassembly comprises an upper insert member receiving a plurality of first contacts and a lower insert member receiving a plurality of second contacts.

14. The electrical connector as claimed in claim 13, wherein the insulative housing defines a plurality of contact receiving passageways in the rear surface thereof, a chamber being defined between the front mating opening and the rear surface for partially receiving the first contacts of the upper insert member of the insert module, a pair of cantilevered arms extending from the rear surface and a pair of securing slots being defined in the rear face, the cantilevered arms and the securing slots defined for engaging with the insert module.

15. The electrical connector as claimed in claim 10, wherein the insulative housing defines a pair of grooves in opposite inner sides thereof, and a pair of recesses in a top face thereof.

16. The electrical connector as claimed in claim 15, wherein the shell includes a pair of inwardly extending cantilevered arms received in the corresponding recesses of the insulative housing and contacting the conductive coating.

17. The electrical connector as claimed in claim 10, wherein the shell has a cavity corresponding to the mating opening of the insulative housing, a pair of inner and outer grounding tabs being formed on opposite sides of the shell, and a rear cover having two bent engaging tab abutting against the opposite of the insulative housing, the rear cover extending from a top surface of the shell.

18. An electric connector comprising:

an insulative housing having a front mating opening for receiving a mating connector and a rear surface; and an insert module attached to an associated circuit board wherein the insert module is generally enclosed in the housing and the circuit board is positioned outside a rear portion of the housing and abuts against the rear surface of the insulative housing, while both the housing and the circuit board are shielded by a shell.

19. An electrical connector for electrically connecting a mating connector, comprising:

an insulative housing defining a front mating opening for receiving a mating connector and a rear surface;

a modular subassembly comprising an insert module fixed to the insulative housing and a circuit board, the insert module comprising an upper insert member receiving a plurality of first contacts and a lower insert member receiving a plurality of second contacts, the circuit board having a conductive coating thereon; and a shell enclosing the insulative housing, the shell being in electrical contact with the conductive coating of the circuit board.

20. An electrical connector for electrically connecting a mating connector, comprising:

an insulative housing defining a front mating opening for receiving a mating connector and a rear surface;

a modular subassembly comprising an insert module fixed to the insulative housing and a circuit board, the circuit board having a tin foil coating thereon; and a shell enclosing the insulative housing, the shell being in electrical contact with the tin foil coating of the circuit board.

21. An electrical connector comprising:

an insulative housing having a front mating opening for receiving a mating connector and a rear surface; and a modular subassembly comprising an insert module fixedly mounted to the insulative housing and a circuit board in electrical contact with the insert module, the circuit board being located adjacent to the rear surface of the insulative housing;

wherein the circuit board defines a pair of cutouts in two opposite side surfaces thereof and the housing forms a pair of cantilevers extending from two opposite sides of the rear surface for securely engaging the cutouts of the circuit board.

* * * * *